US006650057B2

(12) United States Patent
Murao et al.

(10) Patent No.: US 6,650,057 B2
(45) Date of Patent: Nov. 18, 2003

(54) MAGNETRON AND MICROWAVE HEATING DEVICE

(75) Inventors: Noriyuki Murao, Kanzaki-gun (JP); Kazuki Miki, Himeji (JP); Setsuo Hasegawa, Nishiwaki (JP); Noriyuki Okada, Katou-gun (JP); Satoshi Nakai, Kasai (JP)

(73) Assignee: Sanyo Electric Co., Ltd., Osaka (JP)

( * ) Notice: Subject to any disclaimer, the term of this patent is extended or adjusted under 35 U.S.C. 154(b) by 0 days.

(21) Appl. No.: 10/153,300

(22) Filed: May 21, 2002

(65) Prior Publication Data

US 2002/0175627 A1 Nov. 28, 2002

(30) Foreign Application Priority Data

May 22, 2001 (JP) ..... 2001-152195

(51) Int. Cl.[7] ..... H01J 25/50
(52) U.S. Cl. ..... 315/39.51; 315/5.13; 333/182
(58) Field of Search ..... 315/218, 5.13, 315/39.51, 39.53, 39.75; 333/181, 182; H01J 25/50

(56) References Cited

U.S. PATENT DOCUMENTS

| | | | | |
|---|---|---|---|---|
| 4,419,606 A | | 12/1983 | Tsuzurabara et al. | 315/39.51 |
| 5,184,045 A | * | 2/1993 | Im | 315/39.51 |
| 5,977,713 A | * | 11/1999 | Ochiai et al. | 315/39.51 |
| 6,404,301 B1 | * | 6/2002 | Park et al. | 333/182 |

FOREIGN PATENT DOCUMENTS

| | | | | |
|---|---|---|---|---|
| JP | 52-075101 | | 6/1977 | H05K/9/00 |
| JP | 5-82033 | * | 4/1993 | H01J/23/10 |
| JP | 09-167570 | | 6/1997 | H01J/23/15 |
| JP | 11-233-36 | * | 8/1999 | H01J/23/15 |

* cited by examiner

*Primary Examiner*—Don Wong
*Assistant Examiner*—Trinh Vo Dinh
(74) *Attorney, Agent, or Firm*—Darby & Darby

(57) ABSTRACT

A magnetron including a cathode terminal of a magnetron main body and an inductor connected to the cathode terminal to constitute a filter, wherein the inductor includes an air-core coarse inductor and a cored inductor connected in series, the air-core coarse inductor being connected to the cathode terminal side, and the air-core coarse inductor includes a large pitch winding provided on the cathode terminal side and a small pitch winding provided on the opposite side.

9 Claims, 9 Drawing Sheets

MAGNETRON AND MICROWAVE HEATING DEVICE

CROSS-REFERENCE TO RELATED APPLICATION

This application is related to Japanese Patent Application No. 2001-152195 filed on May 22, 2001 whose priority is claimed under 35 USC §119, the disclosure of which is incorporated by reference in its entirety.

BACKGROUND OF THE INVENTION

1. Field of the Invention

The present invention relates to a magnetron. More specifically, it relates to a highly reliable magnetron used in microwave heating devices such as microwave ovens or radars. The magnetron inhibits heat generation by an inductor which constitutes a noise-suppressing filter circuit provided on the input side of the magnetron and prevents reverse heating of a cathode of the magnetron.

2. Description of Related Art

Microwave ovens, which are one of microwave devices, are widely used throughout the world. When noise is caused by the microwave oven, it generates noise in radios, television sets and other telecommunication equipment and their normal operation may be hindered. Therefore, the noise from the microwave oven needs to be prevented. The noise from the microwave oven is mainly generated by a magnetron used as a source of microwave oscillation. The noise caused by the magnetron widely ranges from a low-frequency band of several hundred kHz to a high-frequency band of several dozen GHz.

In a conventional magnetron in which a cathode is arranged in the center of an anode tube and an anode cavity is formed around the cathode, a low-pass filter is utilized as one of means of preventing the noise. As shown in FIG. 7 to FIG. 9, the low-pass filter is comprised of an inductor 54 which is connected to cathode terminals 52 and 53 of a magnetron main body 51 to constitute a noise-suppressing filter circuit on the input side (hereinafter referred to as a cored inductor), and a feed-through capacitor 56. The cathode terminals 52 and 53, the cored inductor 54 and the feed-through capacitor 56 are shielded in a filter box 57. The technique of preventing the noise by using the low-pass filter is most commonly adopted to prevent the noise caused by the magnetron in the microwave oven.

The cored inductor 54 is a radio wave absorber and comprised of a core 54*b* made of ferrite having high relative permeability and a coil 54*a* made of a cupper wire coated with an insulating material such as polyamide imide and wound about the outer circumference of the core 54*b* so that turns thereof are in close contact. The cored inductor 54 is connected to the cathode terminals 52 and 53 with the intervention of an electrical linear portion 54*c*. The length of the linear portion 54*c* is adjusted so that impedance on the cathode terminals 52 and 53 as observed from the cathode will be infinitely large. From the viewpoint of designing the magnetron, the length of the linear portion 54*c* is one of important factors in order to prevent a fundamental frequency of the microwave induced by the cathode (an oscillated frequency, e.g., a microwave of 2,450 MHz) from leaking out of the cathode terminals 52 and 53. Therefore, the length of the linear portion 54*c* is optimally determined in accordance with the design of the magnetron main body 51.

If the fundamental oscillation frequency generated in the magnetron main body 51, for example, part of a microwave output of 2,450 MHz, is leaked into the cathode terminals 52 and 53 together with the noise, the oscillated microwave is wasted and the core 54*b* absorbs the microwave energy. As a result, the oscillation efficiency decreases. Further, if large microwave energy is leaked out, the core 54*b* generates heat and an insulative coating on the coil 54*a* is burned out to cause dielectric breakdown, or the temperature of the feed-through capacitor 56 connected in series is raised to cause dielectric breakdown. Therefore, the length of the linear portion 54*c* is adjusted so that the impedance on the cathode terminals 52 and 53 as observed from the cathode will be the maximum to reduce the leakage of the microwave energy.

Japanese Patent Publication No. 57(1982)-17344 describes a technique of reflecting or attenuating the leaked microwave energy by connecting between the cored inductor and the cathode terminals an air-core inductor which does not have the ferrite core.

However, in view of characteristics of the magnetron, a phenomenon called reverse heating of the cathode should be considered. Among electrons rotating between the anode tube and the cathode of the magnetron, generated are electrons which are accelerated by a high-frequency electric field and then collide against the cathode. The reverse heating of the cathode is a phenomenon in which a filament to constitute the cathode is heated and damaged by the collision of the electrons. If load impedance increases due to the reverse heating of the cathode, life of the filament may be extremely shortened.

The reverse heating of the cathode can also be optimized by adjusting the length of the linear portion 54*c* extending from the cathode terminals 52 and 53 to the cored inductor. However, as shown in FIG. 10, the optimum length with respect to the reverse heating of the cathode and that with respect to the temperature variation of the cored inductor do not agree with each other. FIG. 10 shows the temperature variation of the cored inductor 54 (solid line R1) and the reverse heating of the cathode of the magnetron (broken line R2) with respect to the length of the linear portion 54*c* of the conventional magnetron, respectively. The reverse heating of the cathode of the magnetron is shown by the ratio of filament currents before and after the oscillation expressed as a percentage. The smaller the value is, the greater influence is caused by the reverse heating of the cathode.

Even in the case where the air-core inductor without the core is connected between the cored inductor and the cathode terminals as described in Japanese Patent Publication No. 57(1982)-17344, the length of the linear portion extending from the air-core inductor to the cathode terminals needs to be optimized. Therefore, the design of the inductor is complicated and the size of the whole inductor may increase. Accordingly, an insulating distance between the inductor and the filter box needs to be ensured, which inevitably increases the size of the filter box as well.

SUMMARY OF THE INVENTION

The present invention has been in view of the above-described circumstances. An object of the present invention is to provide a highly reliable magnetron capable of inhibiting heat generation by the inductor which constitutes the noise-suppressing filter circuit provided on the input side of the magnetron and preventing the reverse heating of the cathode of the magnetron, without increasing the size of the filter box.

These and other objects of the present application will become more readily apparent from the detailed description given hereinafter.

In order to achieve the above object, according to the present invention, there is provided a magnetron comprising a cathode terminal of a magnetron main body and an inductor connected to the cathode terminal to constitute a filter, wherein the inductor includes an air-core coarse inductor and a cored inductor connected in series, the air-core coarse inductor being connected to the cathode terminal side and the air-core coarse inductor includes a large pitch winding (hereinafter referred to as a large pitch winding) provided on the cathode terminal side and a small pitch winding (hereinafter referred to as a small pitch winding) provided on the opposite side.

In the invention, it is preferred that an interval between the air-core coarse inductor and the cored inductor connected in series is 3.0 mm or more. It is also preferred that an interval between turns of the small pitch winding is 1.0 mm or less. Further, it is preferred that an interval between turns of the large pitch winding is 1.5 mm or more. Still Further, it is preferred that the number of turns of the small pitch winding is 1.5 or more.

However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

Hereinafter, the magnetron of the present invention will be explained with reference to the attached figures.

Figure 1:
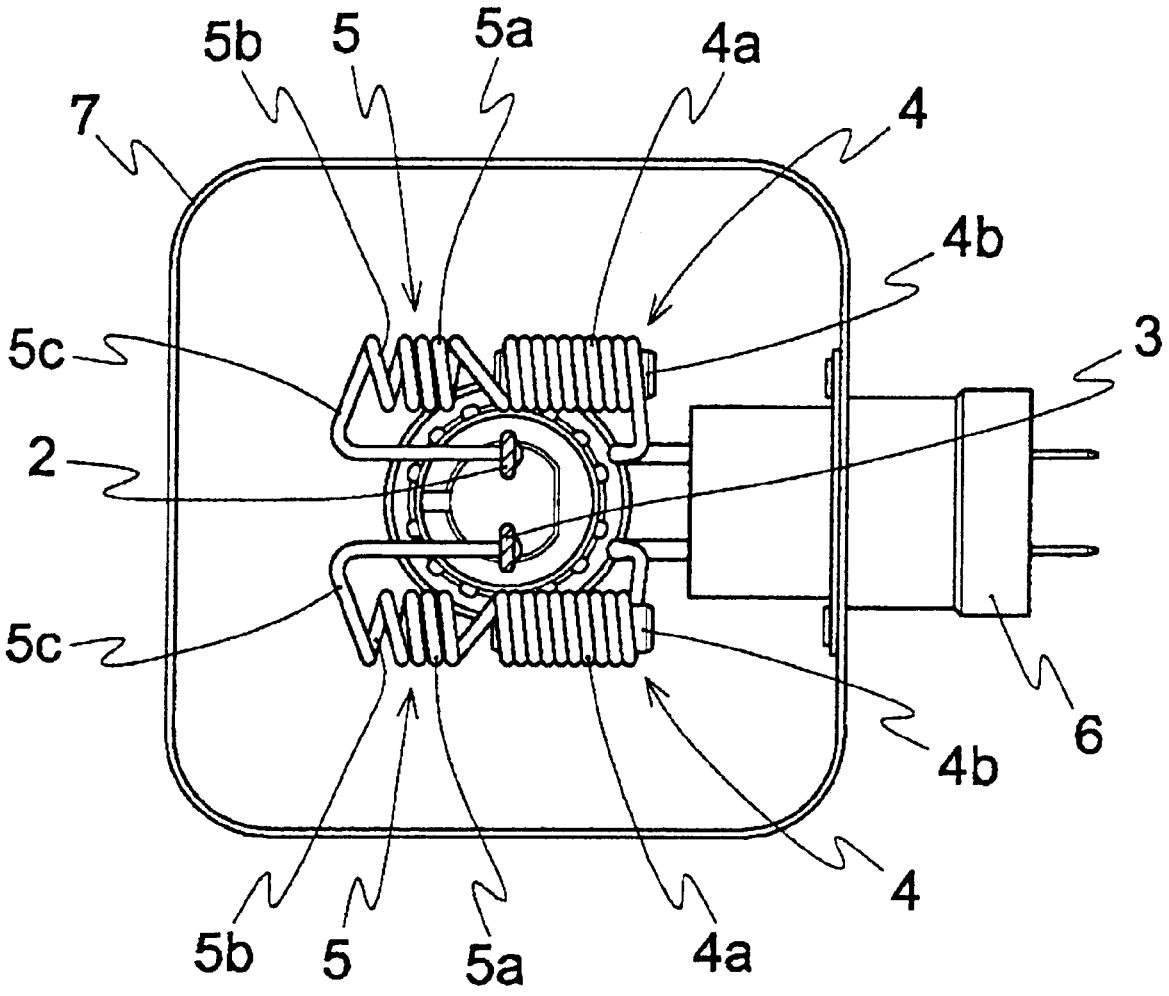
FIG. 1 is a plan view illustrating a filter on the input side of a magnetron according to an embodiment of the present invention.
Figure 2:
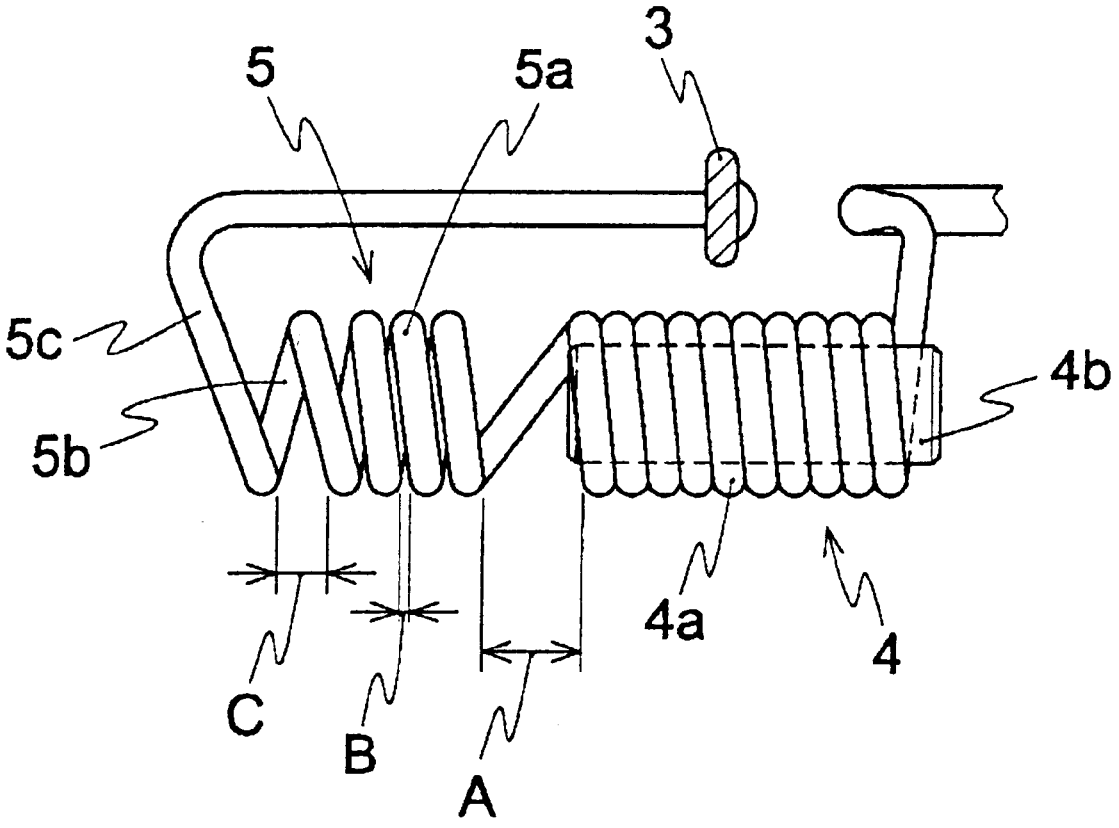
FIG. 2 is an enlarged view illustrating an inductor provided on the cathode terminal side.

FIG. 1 is a plan view illustrating a filter on the input side of the magnetron and FIG. 2 is an enlarged view illustrating an inductor provided on the cathode terminal side.

In the magnetron according to an embodiment of the present invention, a cathode is arranged in the center of an anode tube and an anode cavity is formed around the cathode. Oscillation frequency used for the microwave ovens for household use is 2,450 MHz. As shown in FIG. 1 and FIG. 2, the filter on the input side of the magnetron is connected to cathode terminals 2 and 3 of a magnetron main body (not shown) in the same manner as in a conventional magnetron. A low-pass filter comprising a cored inductor 4 which constitutes a noise-suppressing filter circuit provided on the input side and a feed-through capacitor 6 is utilized. Further, an air-core coarse inductor 5 including a small pitch winding 5*a* and a large pitch winding 5*b* is formed. The large pitch winding 5*b* is connected to the cathode terminals 2 and 3 with the intervention of an electric linear portion 5*c*. The cathode terminals 2 and 3, the cored inductor 4, the air-core coarse inductor 5, the linear portion 5*c* and the feed-through capacitor 6 are shielded in a filter box 7.

The cored inductor 4 is a radio wave absorber and comprised of a core 4*b* of about 5 mm diameter made of ferrite having high relative permeability and a coil 4*a* made of a copper wire of 1.4 mm diameter which is coated with a heat-resistant insulating resin such as polyamide imide and wound about the core 4*b* so that turns thereof are in close contact. For example, the coil 4*a* is made of 9.5 turns of the coated copper wire which are wound in close contact without having an interval therebetween. As regards the cored inductor 4, a wire diameter, the number of turns and a winding pitch of the coil may suitably be selected in accordance with characteristics of the noise filter, adjustment of an appropriate filament current when an inverter power source is driven and the like.

According to the present embodiment, the coil 4*a* is wound about the core 4*b* in a columnar stick shape to form the cored inductor 4. However, in the present invention, the core 4*b* is not limited to such a shape and may have a polygonal shape such as a square. Also, the material of the core 4*b* is not limited to ferrite and magnetic materials such as iron or ceramic may be used. Further, the inner diameter of the coil 4*a* may be formed slightly larger than the outer diameter of the core 4*b*.

The air-core coarse inductor 5 is formed by coarsely winding a copper wire of 1.4 mm diameter coated with a heat-resistant insulating resin such as polyamide imide to have an inner diameter similar to that of the cored inductor 4. The air-core coarse inductor 5 is placed between the cored inductor 4 and the cathode terminals 2 and 3. An interval A between the air-core coarse inductor 5 and the cored inductor 4 is about 4.6 mm.

The small pitch winding 5*a* of the air-core coarse inductor 5 is a coarse coil of 2.5 turns wound at an interval B of about 0.3 mm. The large pitch winding 5*b* of the air-core coarse inductor 5 is also a coarse coil which is wound to have an interval C of about 2.0 mm between the turns thereof.

The effect of the magnetron according to the present embodiment will be described hereinafter. In this embodiment, the air-core coarse inductor 5 includes the small pitch winding 5*a* for inhibiting generation of heat by the inductor and the large pitch winding 5*b* for optimizing an electrical length to suppress reverse heating of the filament. Therefore, increase in microwave leakage from the cathode terminals 2 and 3 is prevented.

First, explanation is given of the large pitch winding 5*b* connected to the cathode terminals 2 and 3 of the magnetron main body. The large pitch winding 5*b* is wound to have an interval C of about 1.5 mm or more between the turns thereof and has no core, so that it actually does not function as an inductor. With a developed length of the large pitch winding 5*b,* an electrical length can be adjusted to suppress a phenomenon called reverse heating of the cathode, i.e., a phenomenon in which a filament comprising the cathode is heated and damaged. If the optimum electrical length is adjusted only by the linear portion 5*c,* the linear portion 5*c* needs to be very long, which leads to upsizing of the filter box. However, by using the large pitch winding 5*b* in the shape of a coil, the required great length of the linear portion 5*c* can be compensated with the developed length of the large pitch winding 5*b.*

The interval C of 1.5 mm or more between the turns of the large pitch winding 5*b* has been obtained through numerous experiments. The results are described below with reference to FIG. 3.

Figure 3:
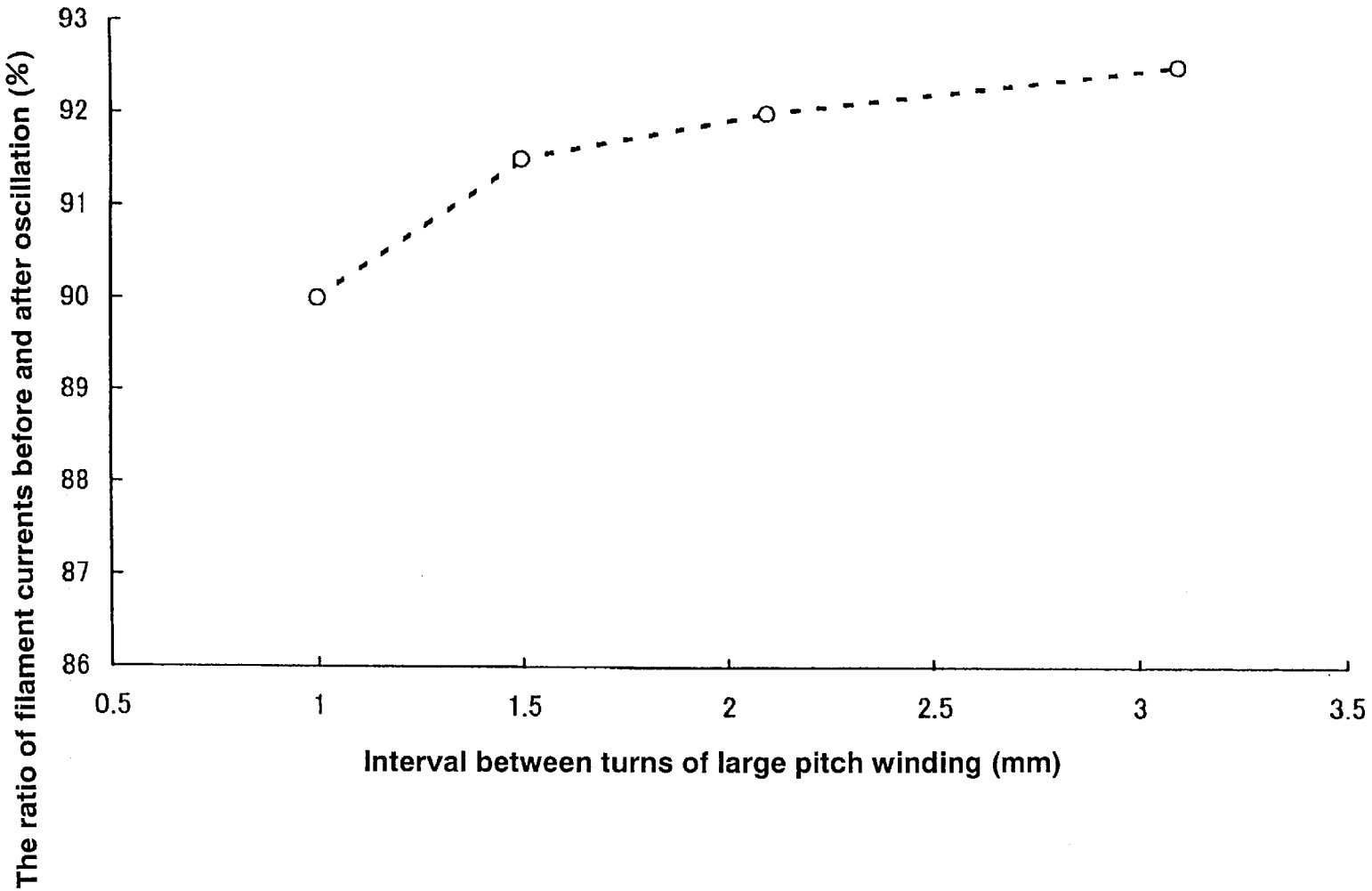
FIG. 3 is a graph illustrating a relationship between an interval between turns of a large pitch winding of an air-core coarse inductor and reverse heating of a cathode of the magnetron.

FIG. 3 shows a relationship between the interval C between the turns of the large pitch winding 5*b* and the reverse heating of the cathode. As mentioned above, the relationship is shown by the ratio of filament currents before and after the oscillation expressed as a percentage. The smaller the value is, the greater influence is caused by the reverse heating of the cathode. First, the optimum electrical length of the linear portion 5*c* (a required electrical length which is unwound and calculated regardless of the size of the filter box) is obtained with respect to the ratio of the filament currents before and after the oscillation. Then, the interval C between the turns of the large pitch winding 5*b* is varied from 1.0 to 3.1 mm so that the developed length of the large pitch winding 5*b* compensates for the length of the linear portion 5*c*. As a result, it is shown that the ratio of the filament currents before and after the oscillation is hardly affected when the interval is 1.5 mm or more. On the other hand, the ratio suddenly decreases when the interval is less than 1.0 mm, which indicates that considerable influence is caused by the reverse heating of the cathode. Since the object of the present invention is not sufficiently achieved when the interval C between the turns of the large pitch winding 5*c* is less than 1.5 mm, it is found that the interval C is preferably 1.5 mm or more, more preferably 2.0 mm or more.

The small pitch winding 5*a* is formed continuously with the large pitch winding 5*b* on the opposite side to the cathode terminals 2 and 3. The small pitch winding Sa is made of an air-core coil of 1.5 turns or more wound at an interval B of 1.0 mm or less. Sometimes a microwave output generated in the magnetron main body is partially leaked as microwave energy through the cathode terminals 2 and 3 and the large pitch winding 5*b*. However, the small pitch winding 5*a* reflects or attenuates the leaked microwave energy. As a result, the oscillation efficiency does not decrease. Even if large microwave energy is leaked, the ferrite core 4*b* does not generate heat. Therefore, dielectric breakdown can be prevented because the insulative coating on the coil 4*a* is not burned out or the temperature of the feed-through capacitor 6 connected in series is not raised.

Figure 4:
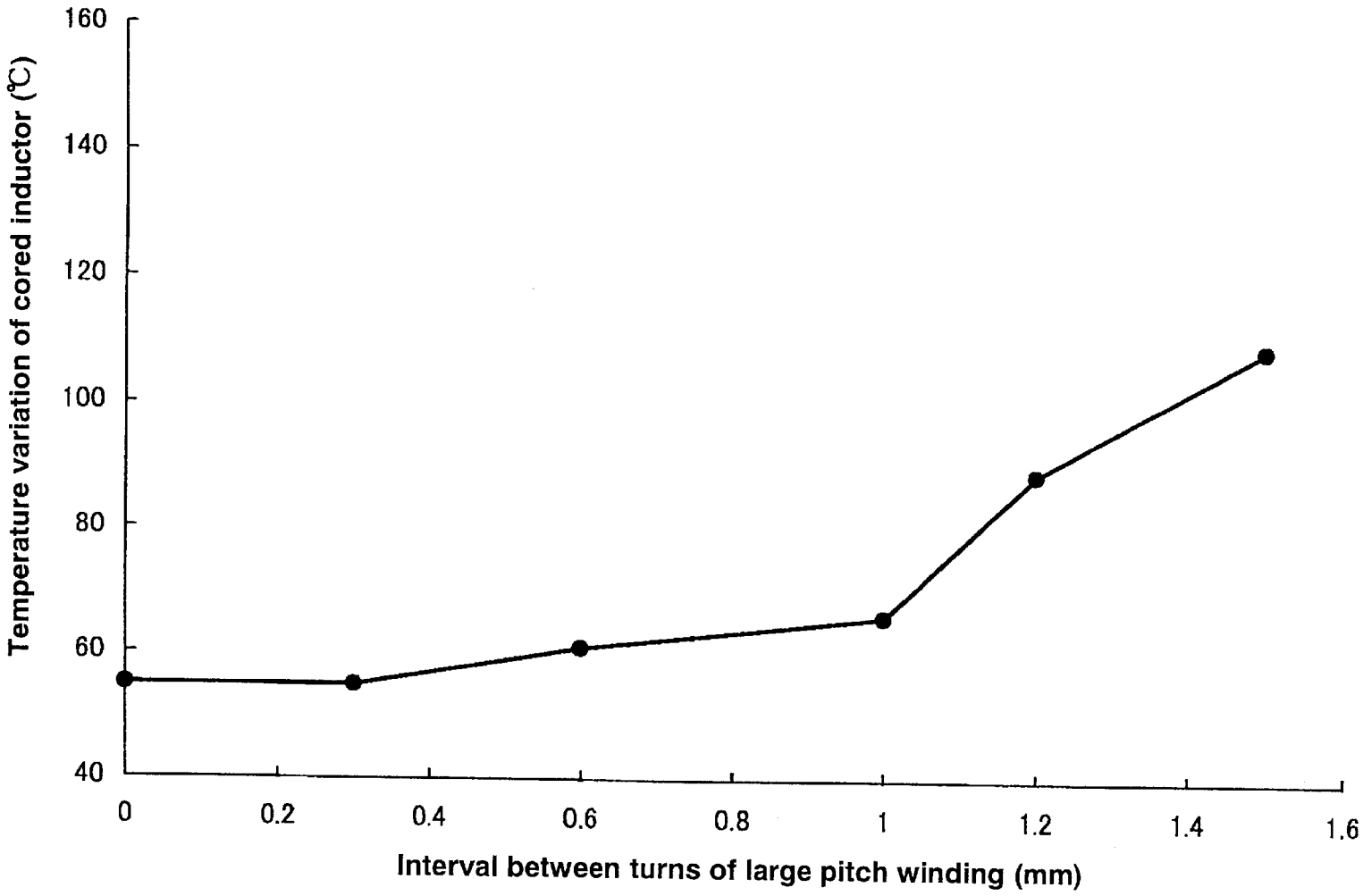
FIG. 4 is a graph illustrating a relationship between an interval between turns of a small pitch winding of the air-core coarse inductor and temperature variation of a cored inductor.
Figure 5:
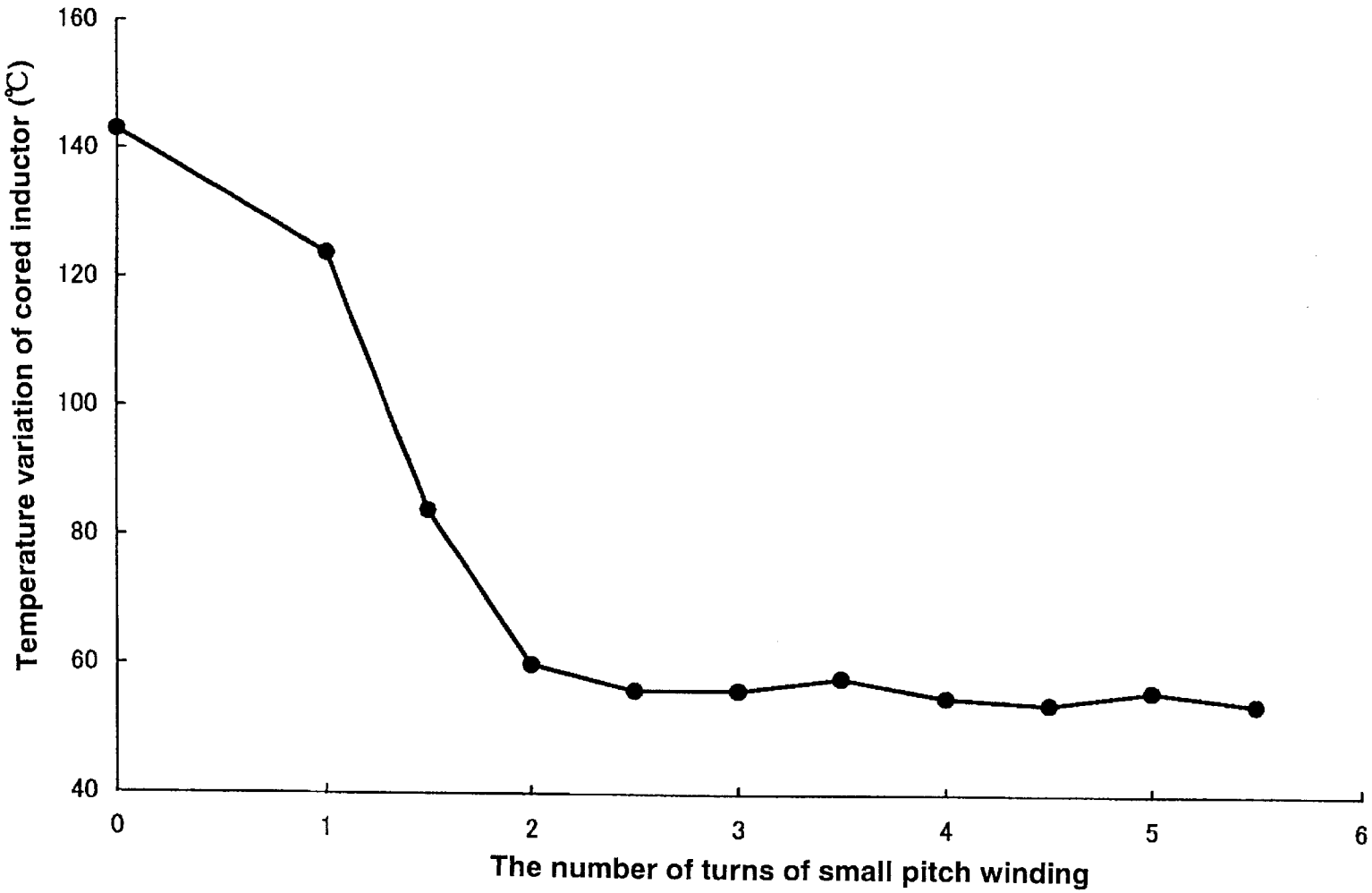
FIG. 5 is a graph illustrating a relationship between the number of the turns of the small pitch winding of the air-core coarse inductor and the temperature variation of the cored inductor.

The interval B of 1.0 mm or less between the turns of the small pitch winding 5*a* has been obtained thorough numerous experiments. As shown in FIG. 4, the effect of reflecting or attenuating the microwave energy leakage is deteriorated when the interval B exceeds 1.0 mm. However, if the small pitch winding 5*a* is so wound that the turns thereof are in close contact, discharge occurs between the turns due to difference in phase of the leaked microwave and the insulative coating on the small pitch winding 5*a* may possibly be burned out to cause dielectric breakdown. Therefore, it is more desired to set the interval B between the turns of the small pitch winding 5*a* to about 0.1 to 1.0 mm in view of manufacturing tolerances of the inductor.

The reason for setting the number of turns of the small pitch winding 5*a* to 1.5 or more is that the effect of reflecting or attenuating the microwave energy leakage is deteriorated when the number of turns is too low. On the other hand, when the number of turns is too high, the size of the filter box may increase. Therefore, the number of turns of the small pitch winding 5*a* is preferably in the range of about 1.5 to 5.5.

Figure 6:
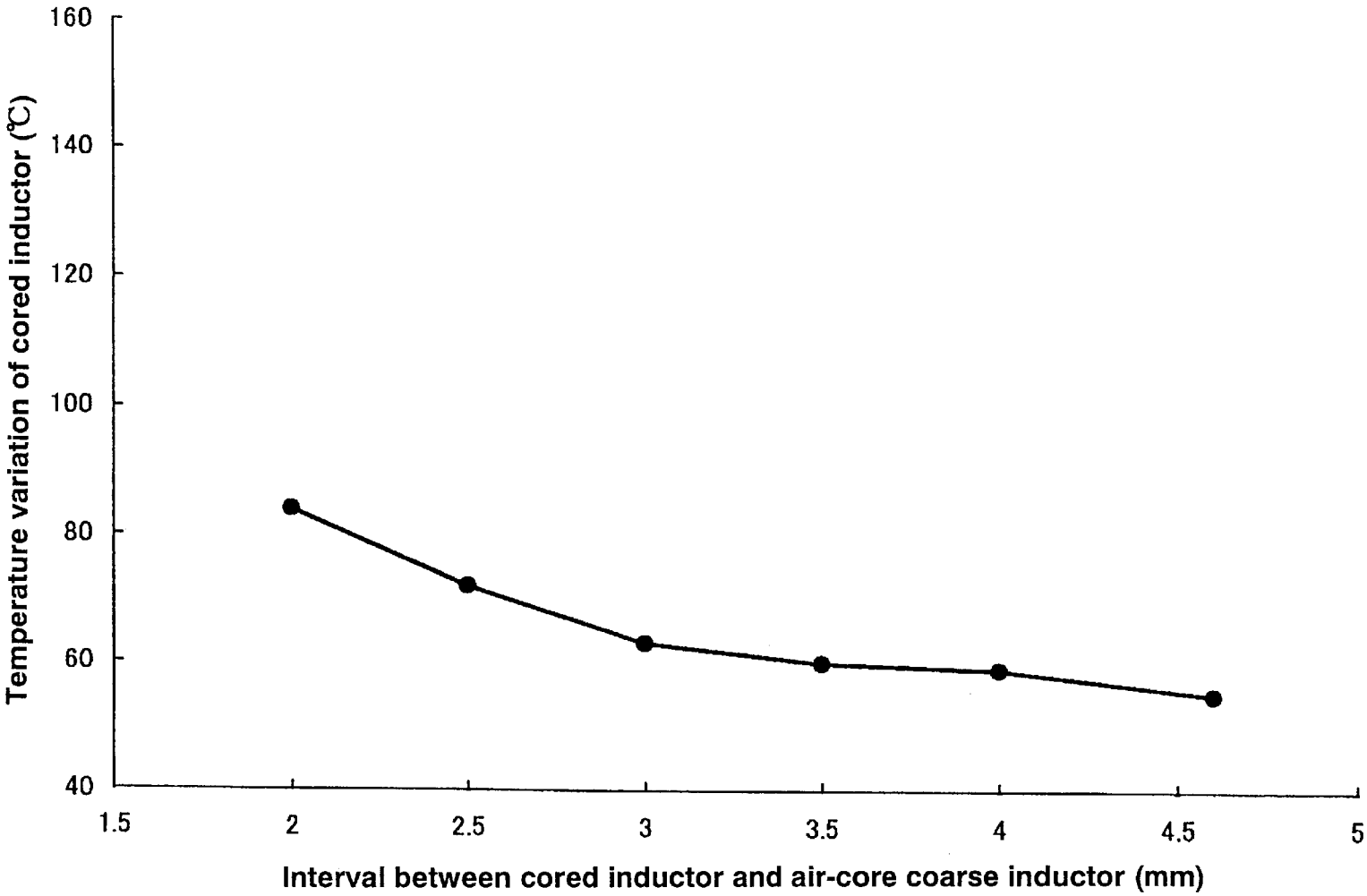
FIG. 6 is a graph illustrating a relationship between an interval between the air-core coarse inductor and the cored inductor and the temperature variation of the cored inductor.
Figure 7:
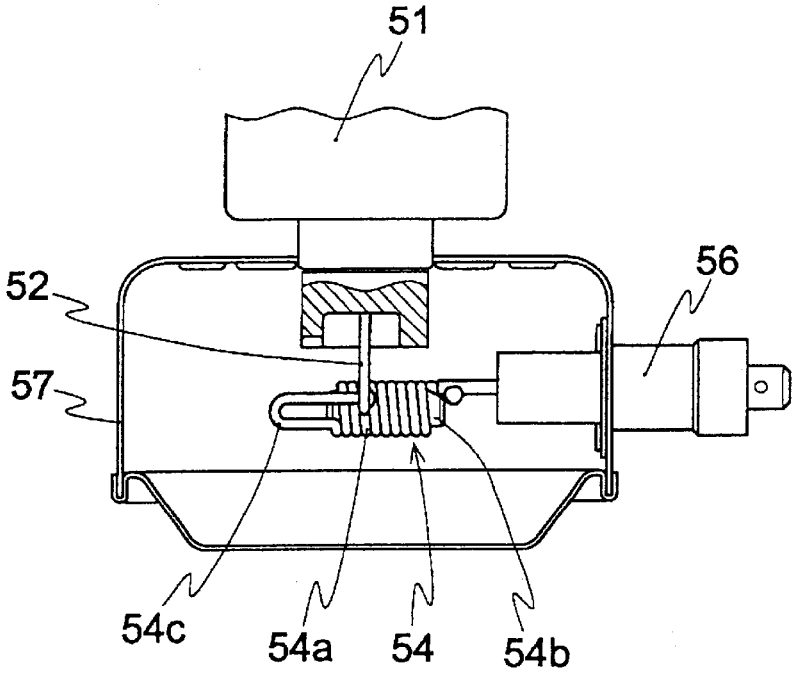
FIG.7(PRIOR ART)
FIG. 7 is a sectional side view illustrating a filter box of a conventional magnetron.
Figure 8:
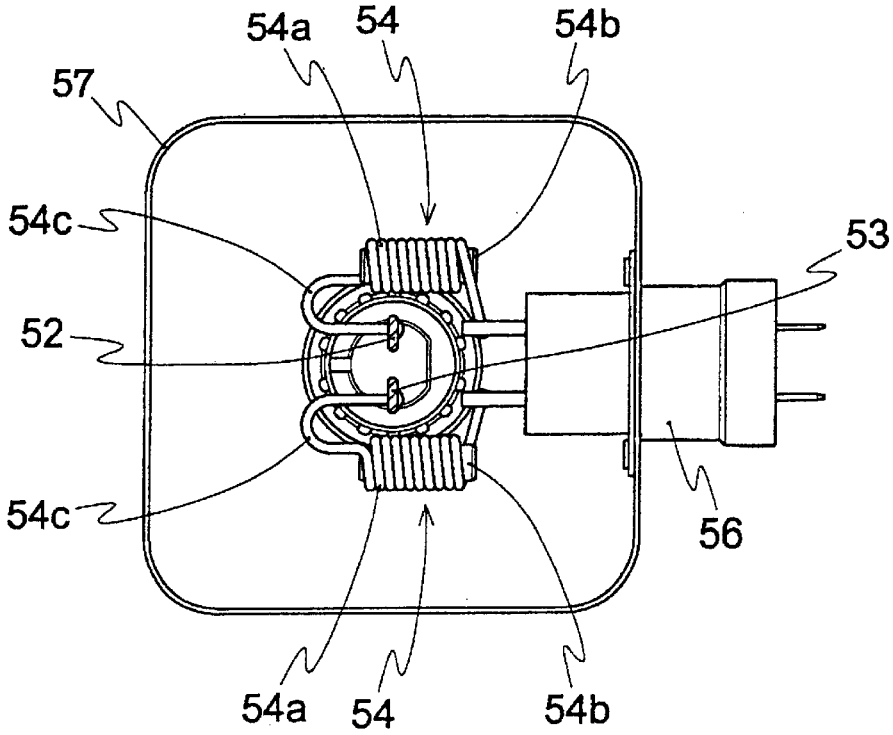
FIG.8(PRIOR ART)
FIG. 8 is a plan view illustrating the filter box of the conventional magnetron.
Figure 9:
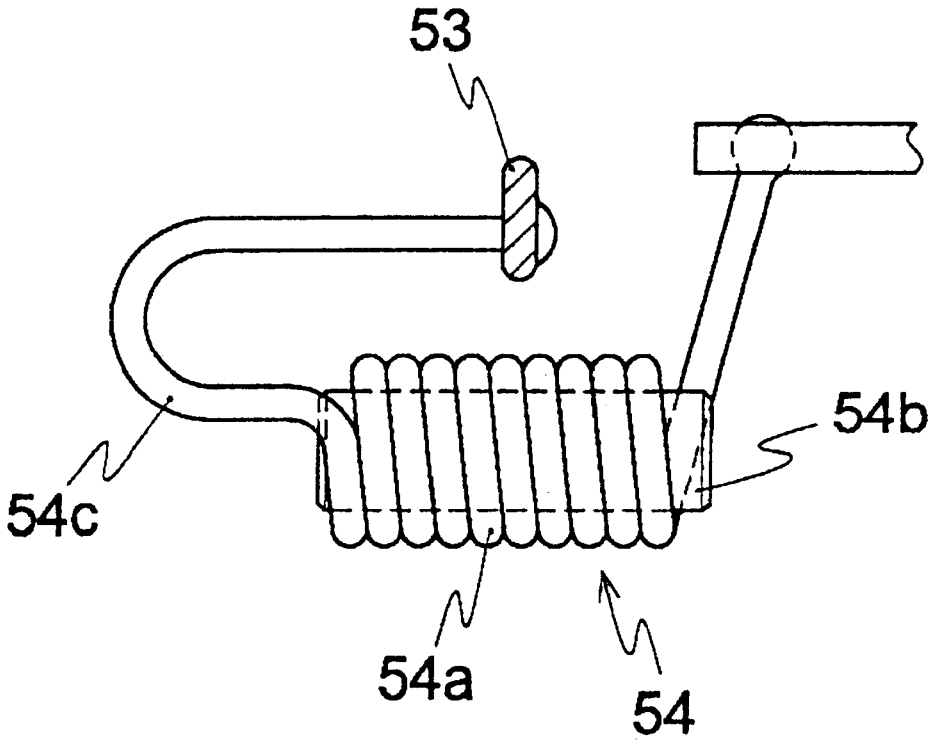
FIG.9 (PRIOR ART)
FIG. 9 is a view illustrating a cored inductor of the conventional magnetron.
Figure 10:
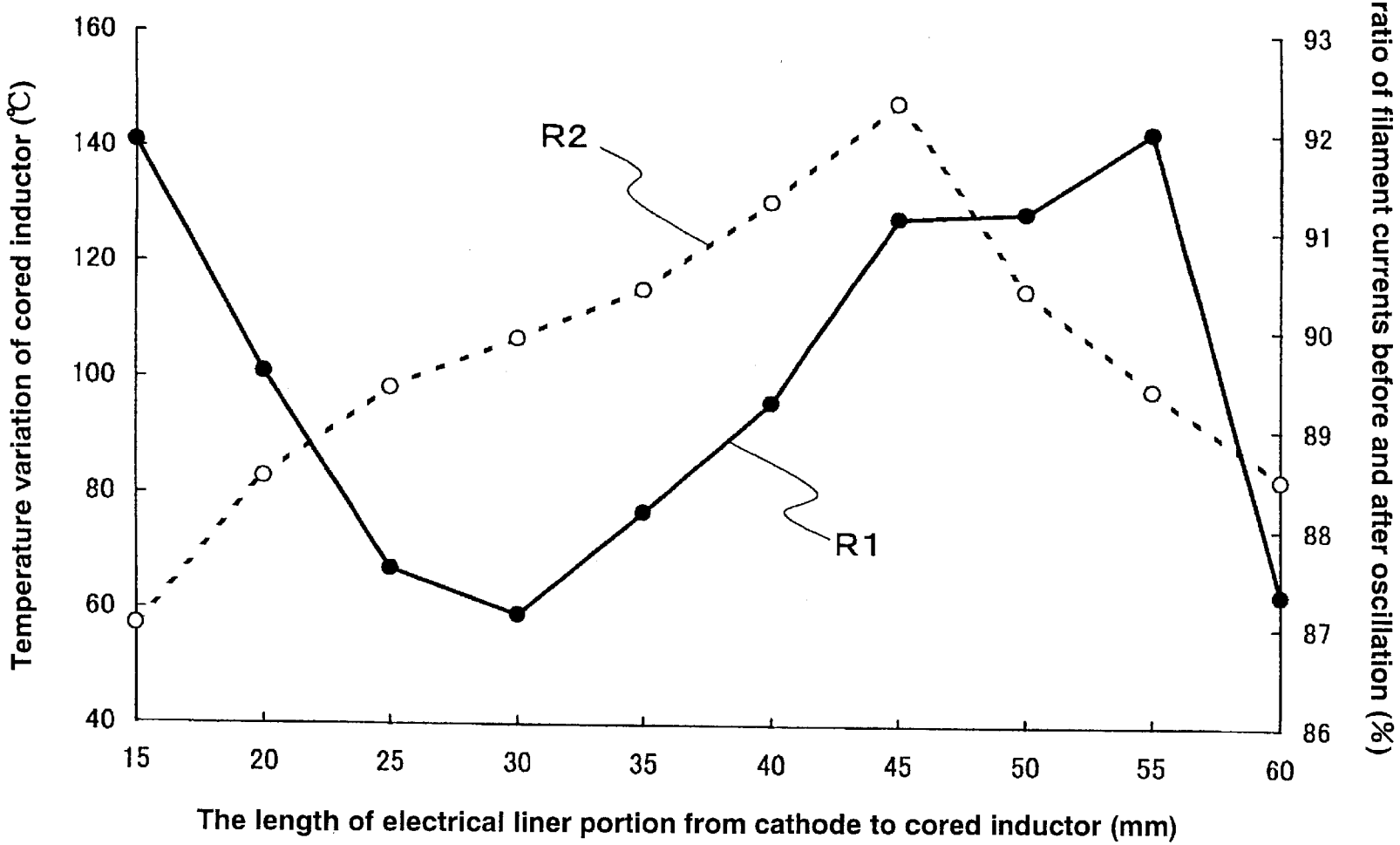
FIG.10 (PRIOR ART)
FIG. 10 is a graph illustrating a relationship between the length of a electrical linear portion of the cored inductor of the conventional magnetron and the temperature variation of the cored inductor, and a relationship between the length and the reverse heating of the cathode of the magnetron.

In accordance with the results of numerous experiments, the interval A between the small pitch winding 5*a* and the cored inductor 4 is determined to 3.0 mm or more as shown in FIG. 6. Thereby, the effect of reflecting or attenuating the leaked microwave energy is improved.

As mentioned above, the magnetron of the present invention is comprised of the air-core coarse inductor and the cored inductor connected in series, and the air-core coarse inductor includes the small pitch winding for inhibiting heat generation by the inductor and the large pitch winding for optimizing the electrical length to suppress the reverse heating of the filament. Thereby, increase in microwave leakage from the cathode terminals is prevented. Thus, a highly reliable magnetron can be obtained without causing burnout of the inductor due to the increase in microwave leakage or damages to the filament due to the reverse heating of the cathode.

Further, since the upsizing of the inductor is unnecessary, the size of the filter box need not be increased. Thus, the magnetron can be obtained without increasing production costs.

What is claimed is:

1. A magnetron comprising:

a cathode terminal of a magnetron main body and an inductor connected to the cathode terminal to constitute a filter, wherein the inductor includes an air-core coarse inductor and a cored inductor connected in series, the air-core coarse inductor being connected to a cathode terminal side and the air-core coarse inductor includes a large pitch winding provided on the cathode terminal side and a small pitch winding provided on an opposite side of the cathode terminal side.

2. The magnetron according to claim 1, wherein an interval between the air-core coarse inductor and the cored inductor connected in series is 3.0 mm or more.

3. The magnetron according to claim 1, wherein an interval between turns of the small pitch winding is 1.0 mm or less.

4. The magnetron according to claim 1, wherein an interval between turns of the small pitch winding is 0.1 mm to 1.0 mm.

5. The magnetron according to claim 1, wherein an interval between turns of the large pitch winding is 1.5 mm or more.

6. The magnetron according to claim 1, wherein an interval between turns of the large pitch winding is 2.0 mm or more.

7. The magnetron according to claim 1, wherein the number of turns of the small pitch winding is 1.5 or more.

8. The magnetron according to claim 1, wherein the number of turns of the small pitch winding is 1.5 to 5.5.

9. A microwave heating device with use of a magnetron according to claim 1.

* * * * *